United States Patent [19]

Paschedag

[11] 4,054,244

[45] Oct. 18, 1977

[54] CENTRIFUGE DRUM EQUIPPED WITH DISCHARGE VALVES

[75] Inventor: Theodor Paschedag, Beckum, Germany

[73] Assignee: Westfalia Separator AG, Oelde Westfalen, Germany

[21] Appl. No.: 719,638

[22] Filed: Sept. 1, 1976

[30] Foreign Application Priority Data

Sept. 3, 1975 Germany ..... 2539074

[51] Int. Cl.[2] ..... B04B 1/14

[52] U.S. Cl. ..... 233/20 A

[58] Field of Search ..... 233/20 R, 20 A, 19 R, 233/19 A, 46, 47 R; 137/513.5

[56] References Cited

U.S. PATENT DOCUMENTS

| | | | |
|---|---|---|---|
| 2,321,887 | 6/1943 | Ayres | 233/20 R |
| 2,467,742 | 4/1949 | Hanno | 233/20 R |
| 2,723,799 | 11/1955 | Sharples | 233/20 R |
| 3,861,415 | 1/1975 | Larsen | 137/513.5 |

*Primary Examiner*—George H. Krizmanich

*Attorney, Agent, or Firm*—Burgess, Dinklage & Sprung

[57] ABSTRACT

A centrifuge having discharge valves 11 for solids at the periphery of the drum. The valve plug or movable valve body is shielded from the pressure within the drum and is urged to the closed position by centrifugal force developed by the drum. The feed passageways or bores for the control liquid employed to operate the valves are disposed in the drum bottom. Thereby obstructions within the drum are avoided.

3 Claims, 4 Drawing Figures

CENTRIFUGE DRUM EQUIPPED WITH DISCHARGE VALVES

BACKGROUND

Figure 1:
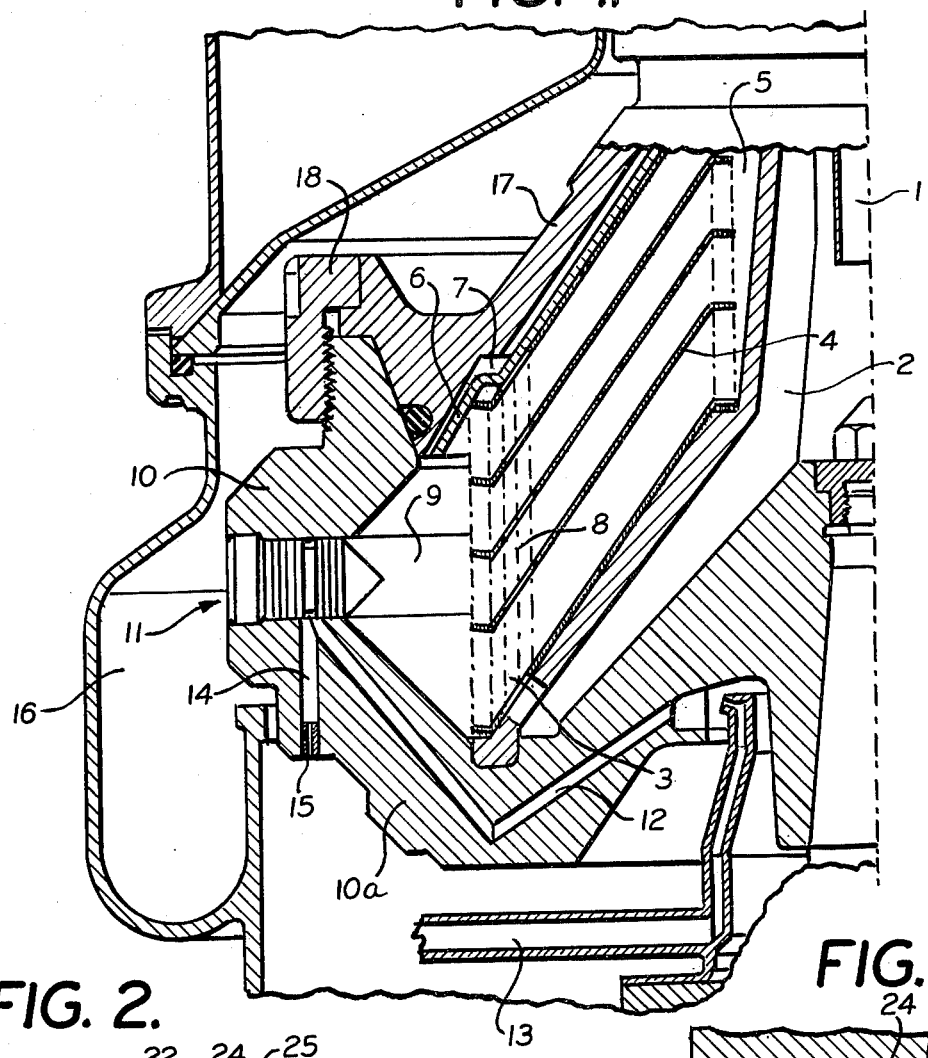

The invention relates to a centrifuge drum with discharge valves for the solids settled out in the clarification or separation of liquids containing solids, in which the valves are distributed uniformly about the circumference in the plane of greatest diameter, the movable valve bodies are shielded against the pressure of the drum charge and are closed by centrifugal force during operation, and can be opened by means of a control liquid while the drum is turning at full speed.

Centrifuge drums of this kind are known, and are used chiefly for liquids which contain solids of soft, yeast-like consistency, such as for example culture filtrates for the production of antibiotics, bacterial cultures, and the like, in which the content of the solids can differ greatly.

A centrifuge drum of this kind is known, for example, from German Pat. No. 924,979. It is a disadvantage in this drum that the valves themselves and the conduits supplying the control liquid are disposed inside of the centrifuge chamber and solids chamber. By this arrangement of the valves and conduits the capacity of the solids chamber is greatly reduced, on the one hand, and on the other hand operations under sterile conditions, which are required or necessary in the case of a great number of liquids, are impossible.

Furthermore, in the event of leaks in the sealing rings, control liquid can find its way into the solids chamber or into the liquid being centrifuged, and in most cases this must be avoided.

Also, the cleaning-in-place system which has been introduced in many industries can be used with only poor success in these drums, since they contain too many places where solid particles can lodge and where they cannot be reached by the cleaning fluid.

FIG. 6 in German Pat. No. 717,992 shows a drum in which the solids chamber is largely free of valve fittings. The chief disadvantage, however, consists in the fact that the valve piston, when operated for opening, has to be moved against the pressure of the solids lodged in the solids chamber and of the liquid charge in the drum.

In many cases, the opening force which has to be produced by the control liquid—normally water—does not suffice to bring the valve piston to the opening position against the above-mentioned pressure acting in the closing sense.

Since the known drums equipped with discharge valves do not satisfy the requirements which a centrifugal separator must today fulfill, more complicated and expensive centrifugal separators are often used for the above-mentioned applications, such as, for example, centrifugal separators of the self-cleaning type equipped with a movable piston slide valve.

Where a plurality of centrifuges must be connected in series, as in the case of the countercurrent extraction of antibiotics, the process then becomes uneconomical.

Precisely for these and other processes, however, centrifugal separators with discharge valves are very desirable since they are substantially simpler in construction, have larger separating chamber and solids chamber capacities, and discharge the settled solids very effectively.

THE INVENTION

It is the object of the invention to construct a centrifugal drum separator with discharge valves such that the drum interior will be free of valve structures and valve conduits, and the settled solids will be able to be removed easily and completely from the drum, so that sterile procedures and easy cleaning will be possible.

This object is achieved in accordance with the invention in that the valves are disposed in the periphery of the drum, and the conduits carrying the control liquid pass through the bottom of the drum.

In further development of the invention, the valve is provided with permanently open, calibrated passages, so that a continuous partial removal of the solids takes place, and only after the solids chamber is virtually completely filled does a complete discharge become necessary, in which case the initiation of the complete discharge of the solids can be based on surveillance of the clarity of the liquid, for example by means of a photoelectric cell.

In this manner the discharge intervals can be appreciably farther apart, and the disturbances are avoided which occur in the case of the simultaneous separation of liquid mixtures into their components due to the displacement of the zone of separation during the discharge of the solids. Valves with permanently open, calibrated passages are especially advantageous when the solid content of the mixture being separated is high.

Figure 2:
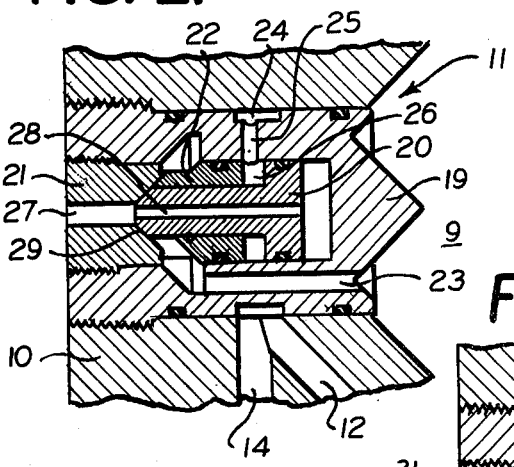
Figure 3:
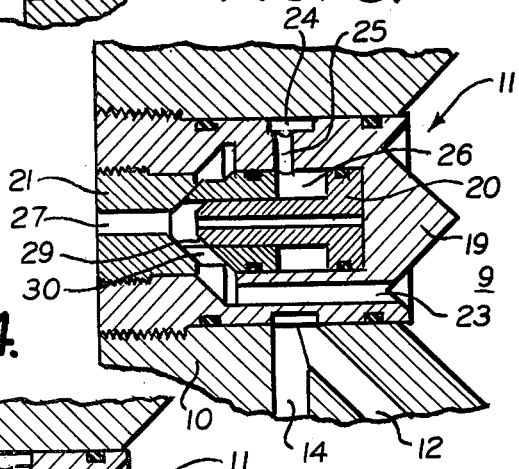
Figure 4:
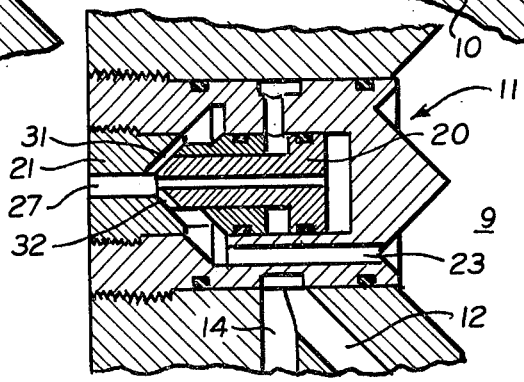

An embodiment of the invention is represented in the drawing, wherein:

FIG. 1 is a longitudinal cross sectional view of the left half of a separating drum constructed in accordance with the invention, FIG. 2 is a cross sectional view through the closed valve on an enlarged scale, FIG. 3 is a cross sectional view through the open valve on an enlarged scale, and FIG. 4 is a cross sectional view through the valve on an enlarged scale showing additional calibrated passages or slits in the valve piston or in the valve cone.

With reference to FIG. 1, the liquid mixture containing solids to be separated is carried centrally through the inlet tube 1 into the distribution chamber 2, flows through the ascending passaages 3 in the disk stack 4, the components of the liquid which are lighter in specific weight flowing inwardly through the disk stack and being carried out through the passage 5 which can empty into a paring chamber. The separated, specifically heavier component flows radially through the disk stack to the periphery of the drum, passing around the separating disk 6 and out through passages 7. The line 8 designates the zone of separation between the specifically lighter and specifically heavier component. The solid matter, which is also spun outwardly, collects in the solids chamber 9. In the drum periphery 10 are located the discharge valves 11 which are uniformly spaced along the periphery. In the drum bottom **10*a* are the passages 12 for the supply of the controlling liquid. The opening of the valves 11 is accomplished by feeding a control liquid to them through a supply conduit 13 disposed outside of the drum. The discharge of the control liquid from the valves 11 when the feed is shut off takes place through the drain passages 14, which are provided with a throttling means 15. The solids are thrown from the valves into the sludge receiver 16. The drum is closed by a lid 17, which is tightly screwed down against the drum periphery 10 by means of the threaded closure ring 18, so that the separating chamber 9***a* is provided within the drum.

FIG. 2 shows an enlarged cross sectional view taken through the closed discharge valve 11, and FIG. 3 through the open discharge valve 11, which comprises the valve housing 19, the valve body 20, the valve seat 21, the guide 22 and various gaskets. In the valve housing 19 are the drain passages 23 for solids, and, for control liquid, an annular groove 24 and bores 25 which communicate with the annular groove 26. Annular groove 24 is also in communication with the drain passage 14 and the control liquid supply passage 12. In the valve seat 21 there is a passage 27 through which the solids are ejected when the valve is in the open state. Passage 28 in valve body 20 is a vent passage.

The valve operates as follows. During operation, the conical end face 29 of the valve body 20 guided sealingly in the valve housing 19 and guide 22 closes the discharge bore 27 in valve seat 21 and thus prevents solid matter from emerging from the solids chamber 9. When the solids chamber 9 has to be emptied, control liquid is fed through conduit 13 into the passages 12 in the drum bottom 10*a*. It flows from the annular groove 24 in valve housing 19 through bores 25 into the annular groove 26 where a liquid pressure builds up which displaces valve body 20 in the radial direction toward the drum axis, against the centrifugal force, and uncovers the gap 30 between the conical end face 29 of valve body 20 and of valve seat 21, so that the solids are driven by centrifugal force through bores 23, annular gap 30 and bore 27 and out of the drum. When the supply conduit 13 is shut off, the control liquid escapes through the drain passage 14 which has at its outlet a throttling means 15 in order to permit a build-up of pressure in the annular groove 26 when control liquid is being fed in. When the annular groove 26 begins to empty, the valve body 20 closes the discharge bore 27.

FIG. 4 shows a cross sectional view taken through the valve 11 designed for the additional continuous removal of a certain amount of solids during operation. For this purpose either calibrated passages or slits 31 are provided in the valve seat 21, or calibrated passages or slits 32 are provided on the end face of the valve body 20, so that a certain amount of solids will continually be let out of the solids chamber through bores 23, the said calibrated passages, and the discharge bore 27. At certain intervals of time a complete emptying or an additional partial emptying of the solids chamber 9 can be performed by a more or less brief opening of the valve. If desired calibrated passages 31 and 32 can be provided in both valve seat 21 and valve body 20, as shown in FIG. 4.

What is claimed is:

1. In a centrifuge having a drum bottom and a drum lid defining a separating chamber, discharge valves having valve seats, movable valve bodies for the opening and closing of the valves by movement of the valve bodies off and onto the valve seats, for discharge of solids settled out in the clarification or separation of solids-containing liquids, and valve housings in which the valve bodies are housed and which shield the valve bodies against the pressure of the drum charge, and means defining passages from the chamber to the valve seats for discharge of the solids from the chamber when the valves are open, feed passages for control liquid for operation of the valves, in which the valves are uniformly distributed about the periphery of the separating chamber, and are closed by cerntrifugal force during operation, and means for opening the valves with a control fluid while the drum is at full speed, the improvement which comprises said means for opening the valves with control fluid comprising feed passages for the control fluid disposed in the drum bottom and bores in the housings in communication with the feed passages in the drum bottom, for conveyance of control fluid to the moveable valve bodies for the operation thereof for opening and closing of the valves.

2. Centrifuge of claim 1, the valves comprising valve seats for receiving the movable valve bodies for closing of the valve seats having passages for continuous removal of solids.

3. Centrifuge of claim 1, the movable bodies having passages for continuous removal of solids.

* * * * *